US006235077B1

(12) United States Patent
Kagohashi et al.

(10) Patent No.: US 6,235,077 B1
(45) Date of Patent: May 22, 2001

(54) PROCESS FOR PRODUCTION OF NICKEL POWDER

(75) Inventors: Wataru Kagohashi; Tsuyoshi Asai; Hideo Takatori, all of Chigasaki (JP)

(73) Assignee: Toho Titanium Co., Ltd., Chigasaki (JP)

( * ) Notice: Subject to any disclaimer, the term of this patent is extended or adjusted under 35 U.S.C. 154(b) by 0 days.

(21) Appl. No.: 09/381,312

(22) PCT Filed: Feb. 16, 1999

(86) PCT No.: PCT/JP99/00665

§ 371 Date: Oct. 12, 1999

§ 102(e) Date: Oct. 12, 1999

(87) PCT Pub. No.: WO99/42237

PCT Pub. Date: Aug. 26, 1999

(30) Foreign Application Priority Data

Feb. 20, 1998 (JP) ..... 10-055914

(51) Int. Cl.[7] ..... B22F 9/28
(52) U.S. Cl. ..... 75/369; 75/374; 75/629
(58) Field of Search ..... 75/367, 369, 374, 75/629

(56) References Cited

U.S. PATENT DOCUMENTS

| | | | | |
|---|---|---|---|---|
| 3,586,497 | * | 6/1971 | Gravenor et al. | 75/629 |
| 5,853,451 | * | 12/1998 | Ishikawa | 75/367 |
| 6,090,179 | * | 6/2000 | Rosenband et al. | 75/369 |

FOREIGN PATENT DOCUMENTS

| | | |
|---|---|---|
| B1-42-10074 | 5/1967 | (JP) . |
| 63-312603 | 12/1988 | (JP) . |
| 1-116013 | 5/1989 | (JP) . |
| 5-247506 | 6/1993 | (JP) . |
| 8-246001 | 9/1996 | (JP) . |

* cited by examiner

*Primary Examiner*—George Wyszomierski
(74) *Attorney, Agent, or Firm*—Oliff & Berridge, PLC

(57) ABSTRACT

Chlorine gas from a supply nozzle is mixed with the vapor of nickel chloride and the mixed gas is supplied from a supply nozzle into a hydrogen gas atmosphere in a reduction reactor at a reduction temperature of 900 to 1100° C. The volume of chlorine gas to be mixed versus the vapor of nickel chloride is adjusted to a ratio of 0.01 to 0.5 moles per mole of the vapor of nickel chloride. The particle size of the nickel powder can be controlled appropriately, and also, uniformity of particle size, smoothability of surfaces of particles, and sphericity can be improved.

6 Claims, 1 Drawing Sheet

PROCESS FOR PRODUCTION OF NICKEL POWDER

TECHNICAL FIELD

The present invention relates to a process for production of a nickel powder suitable for various uses such as conductive paste fillers used for electrical parts, bonding material for titanium, and for catalysts, and in particular, relates to a process which can control the particle size in a range of less than 1.0 μm, which is a suitable particle size for a internal electrode of a multi-layer ceramic capacitor, and which can produce a nickel powder having a spherical shape and a narrow particle size distribution.

BACKGROUND ART

Conductive metallic powders such as those of nickel, copper, and silver are useful for internal electrodes in multi-layer ceramic capacitors; in particular, nickel powder has been recently studied for such purposes. Nickel powder produced by a dry production process is seen as being promising. In particular, an ultra fine powder having a particle size of less than 1.0 μm is demanded because of requirements to form a thin layer and to have low resistance in accordance with tends toward miniaturization and larger capacity of capacitors.

As one of the process for production of the fine nickel powder, a gas phase reduction process may be mentioned. For instance, JP-A-8-246001 discloses a process in which a reactor is filled with a vapor of nickel chloride by heating and vaporizing (subliming) a solid mass of nickel chloride, hydrogen gas is supplied with an inert gas such as argon gas, and a reducing reaction occurs by contacting and mixing to form a nickel powder. According to this publication, a nickel powder having a 0.1 μm to 1.0 μm aver age particle size can be prepared by the process.

Although a nickel powder having a particle size within a desired range (0.1 to 1.0 μm) can be obtained by the conventional process for production of a nickel powder disclosed in the above publication, it is difficult to control the required particle size more exactly within the range. To form a paste of a nickel powder, an advantageous condition includes an even and uniform particle size, a high smoothability of the particle surfaces, and a high sphericity. However, the conventional production processes cannot satisfy these conditions to a high level.

Objects of the present invention are to provide a process for production of a nickel powder, in which the particle size of the nickel powder may be freely controlled 1.0 μm, especially within the range of 0.1 to 1.0 μm, to improve smoothability of particle surfaces and to improve sphericity of the powder.

DISCLOSURE OF THE INVENTION

To solve the foregoing problems, the present inventors have studied various additional factors including additives and volumes of gas supplied, which affect characteristics of particles in nickel powder formed In the process as a basic reduction process to form a nickel powder, wherein a vapor of nickel chloride is supplied to a reduction reactor filled with a reductive gas including hydrogen gas, and thereafter the vapor of nickel chloride is reduced by the reductive gas. As a result, by supplying an appropriate volume of chlorine gas to an atmosphere of a reductive gas with a vapor of nickel chloride, the present Inventors have found that the particle size of the formed nickel powder can be controlled to a desired range, smoothability of particle surfaces, sphericity, and particle size distribution can be improved.

In the present invention, chlorine gas is supplied with a vapor of nickel chloride to an atmosphere of a reductive gas, and nickel chloride is reduced to produce nickel powder.

As a reductive gas used in the present invention, hydrogen gas or hydrogen sulfide gas is used. When effects on particles of a formed nickel powder are considered, hydrogen gas is preferable.

The volume of chlorine gas to be supplied is preferably at a ratio of from 0.01 to 0.5 moles per 1 mole of vapor of nickel chloride, and more preferably, at a ratio of from 0.03 to 0.40 moles, so that a nickel powder having a particle size of 0.1 to 1.0 μm is stably formed. It was confirmed that the particle size of nickel powder increased in proportion to the mixing volume of chlorine gas. That is the greater the volume of chlorine gas is supplied, the more of the growth of particles of nickel powder is promoted. The formed nickel powder can be controlled to a desired particle size based on the above. It is an important feature of the present invention that particle size can be freely controlled by utilizing the phenomenon of particle size of nickel powder increasing in proportion to volume of chlorine gas supplied, as described above.

In the present invention, chlorine gas is supplied with a vapor of nickel chloride to a reduction rector wherein the atmosphere is a reductive gas. Various methods can be adopted as the supplying method. Specifically, chlorine gas is mixed with a vapor of nickel chloride beforehand, and the mixed gas is then supplied to a reduction reactor. Alternatively, chlorine gas is continuously supplied with a vapor of nickel chloride to a reduction reactor or only chlorine gas is supplied intermittently by installing a supply nozzle for the vapor of nickel chloride and a supply nozzle for chlorine gas separately and positioning the nozzle together. The former method and the latter method can be combined, that is a method in which a mixed gas of a vapor of nickel chloride and chlorine gas and a chlorine gas are respectively supplied from separate nozzles to a reduction reactor can be employed.

Among the above methods, the method in which chlorine gas is supplied continuously from an adjoined nozzle is preferred because smoothability of surfaces of the nickel powder can be improved. The method in which chlorine gas is supplied intermittently from adjoined nozzles is preferable because-growth of icicles of nickel powder can be prevented from forming at the nozzles. In a conventional method, nickel powder formed by reduction adheres to a nozzle jetting a vapor of nickel chloride into a reduction reactor and occasionally grows like an icicle. If this occurs, the supply of the vapor of nickel chloride is affected, and as a result, adversely affects particle characteristics of a nickel powder to be formed. Therefore, solutions to these problems are necessary.

Various methods can be adopted as measures for separately installing the nozzles for the vapor of nickel chloride and chlorine gas and for adjoining the nozzles. Preferably, a nozzle is a double tube in which an internal tube is arranged coaxially with an external tube. By providing a double tube nozzle, a vapor of nickel chlorine gas may be supplied from one of the internal tube and the external tube of the double nozzle, and chlorine gas may be supplied from the other tube to a reduction reactor. In particular, by supplying a vapor of nickel chloride from an internal tube and chlorine gas from an external tube, the chlorine gas surrounds the vapor of nickel chloride, whereby growth of icicles of nickel powder at a supplying nozzle for nickel chloride described above can be prevented and spericity of nickel powder to be formed can be improved.

As a reduction reactor used in a process for production for nickel powder of the present invention, a vertical type reduction reactor, wherein a supply nozzle for a vapor of nickel chloride and chlorine gas is arranged, for instance, as a double tube as mentioned above, is preferably used.

Moreover, as a supply method for the vapor of nickel chloride and chlorine gas in a reduction reactor of the present invention, a method is preferably used wherein a vapor of nickel chloride and chlorine gas are supplied nearly downward and vertically from the nozzle toward the inside of a reduction reactor in a vertical reduction reactor in which the supply nozzle is at the top of the reactor.

As mentioned above, by using a vertical type reduction reactor and adopting a method in which a vapor of nickel chloride and chlorine gas are supplied nearly downward and vertically toward the inside of a reduction reactor, a nickel powder, which can be controlled to a desired particle size, have improved smoothability of particle surfaces, sphericity, and particle size distribution, can be produced, in accordance with the present invention.

In the present invention as described above, a vapor of nickel chloride and chlorine gas are supplied in an atmosphere of a reductive gas. In the process, each of the vapor of nickel chloride and the chlorine gas can be supplied after these are mixed and diluted with an inert gas such as nitrogen gas or argon gas as a carrier gas.

Moreover, a vapor of nickel chloride, chlorine gas, and a reductive gas such as hydrogen gas to be supplied to a reduction reactor are preferably preheated before being supplied to a reduction reactor. The preheating is preferably conducted in a temperature range of the reduction temperature in the reduction reactor, as described below.

The temperature of reduction in the present invention is 900 to 1200° C., preferably 950 to 1100° C., and more preferably 980 to 1050° C.

BEST MODE FOR CARRYING OUT THE INVENTION

A preferred embodiment of the invention will be explained hereinafter with reference to the accompanying drawings.

Figure 1:
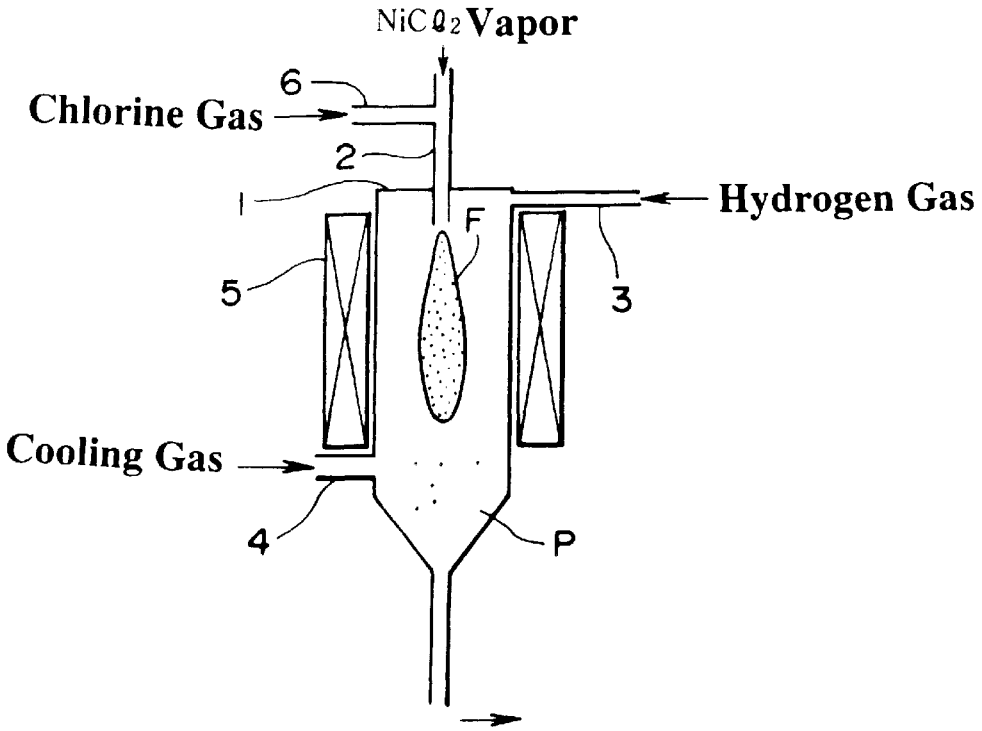
FIG. 1 is a drawing of a vertical section showing an example of an apparatus for production of a nickel powder according to the present invention.

FIG. 1 shows a vertical reduction reactor 1 preferred for conducting an embodiment of the present invention. At the top of the reduction reactor 1, a supply nozzle 2 for jetting a vapor of nickel chloride into the reactor is protruding downward and vertically. A double nozzle, as described above, may be used as the supply nozzle 2. At the upper end of the reduction reactor 1, a supply nozzle 3 for hydrogen gas is located at the upper part of the nozzle of the supply nozzle 2. A supply nozzle 4 for a cooling gas is connected to the side of the bottom of the reduction reactor 1. A heating unit 5 is fitted around the reduction reactor 1. The supply nozzle 2 has a function of jetting a vapor of nickel chloride into the reduction reactor 1 at a preferable flow rate. A supply nozzle 6 for chlorine gas is connected to the supply nozzle 2.

In the embodiment of the present invention, a vapor of nickel chloride formed by chlorinating a nickel metal with chlorine gas or a vapor of nickel chloride formed by vaporizing a commercially available solid mass of nickel chloride is jetted from the supply nozzle 2 into the reduction reactor 1, which has been filled with a hydrogen atmosphere by supply hydrogen gas from the supplying nozzle 3 for hydrogen gas. Among these methods for forming a vapor of nickel chloride, in the latter method, it is difficult to stably form a vapor in heating and vaporizing a solid of nickel chloride. As a result, particle sizes in the nickel powder are not uniform. Moreover, because a solid of nickel chloride normally contains crystals of water, it is necessary to dehydrate it before use. If the dehydration is insufficient, problems such as contamination of the nickel powder to be formed may occur. From these aspects, preferred the former method in which a vapor of nickel chloride formed by chlorinating a nickel metal with chlorine gas to be supplied directly to a reduction reactor is preferred.

Chlorine gas from the supply nozzle 6 is mixed with the vapor of nickel chloride. That is, the mixed gas of a vapor of nickel chloride and chlorine gas is jetted from the supply nozzle 2. The volume of chlorine gas to be supplied is 0.01 to 0.5 moles per one mole of vapor of nickel chloride; specifically preferred is 0.03 to 0.4 moles in order to ensure formation of nickel powder having a particle size from 0.1 to 1.0 $\mu$m.

When the mixed gas of a vapor of nickel chloride and chlorine gas is supplied into the reduction reactor 1 containing a hydrogen gas atmosphere, the reduction of the vapor of nickel chloride by hydrogen gas proceeds and a nickel powder P is formed. In the process for forming the nickel powder P, a flame F, which is like a burning flame of a liquid fuel such as LPG and is aimed downward, is formed at the tip of the supply nozzle 2.

By adjusting the jetting rate (linear velocity) of a mixed gas of a vapor of nickel chloride and chlorine gas from the tip of the supply nozzle 2 in combination with varying the aforementioned mixed rate of chlorine gas and a vapor of nickel chloride, the particle size of the nickel powder P to be obtained can be controlled to a desired particle size within a target range (from 0.1 to 1.0 $\mu$m).

A preferable linear velocity, which is a calculated value converted into a volume of supplied gas based on an ideal gas at a reduction temperature, of a vapor of nickel chloride and chlorine gas at the tip of the supply nozzle 2 is set from 1 to 30 m/sec at 900 to 1100° C. reduction temperature. In the case in which a nickel powder having a small particle size such as 0.1 to 0.3 $\mu$m is produced, 5 to 25 m/sec velocity is preferable, and in the case in which a nickel powder having a particle size of 0.4 to 1.0 $\mu$m is produced, 1 to 15 m/sec velocity is preferable.

The volume of hydrogen gas to be supplied into the reduction rector 1 is 1 to 3 times the chemical equivalent of a vapor of nickel chloride, and preferably 1.1 to 2.5 times, but it is not limited to this. However, when hydrogen gas is supplied in excess, a large stream of hydrogen gas is brought into the reduction reactor 1, causing uneven reduction because the jetting stream of vapor of nickel chloride from the supply nozzle 2 becomes turbulent and also it is uneconomical because gas which is not used is vented. A reduction temperature can be adopted which is a higher temperature sufficient to complete the reaction. Preferably, the temperature is above the melting point of nickel, because it is easy to handle a nickel powder formed as a solid. When reaction rate, durability of the reduction reactor 1, and economy are considered, a temperature from 900 to 1100° C. is practical, but the temperature is not limited to this range. The linear velocity of hydrogen gas in an axial direction (a vertical direction) in the reduction reactor 1 is 1/50 to 1/300 times the jetting velocity (linear velocity) of the vapor of nickel chloride and is preferably 1/80 to 1/250. In addition, the vapor of nickel chloride is substantially jetted from the supply nozzle 2 into a static atmosphere of hydrogen gas because the supply nozzle 3 for hydrogen gas is located at the upper part of the nozzle of the supply nozzle 2. Therefore, the aforementioned flame F is not disordered and the nickel powder P can be stably formed. Moreover, in order to prevent disorder of the flame F, preferably, hydrogen gas supplied from the supply nozzle 3 is not directed to the side of the flame F.

A gas containing the nickel powder P formed by passing the aforementioned reduction process is cooled by blowing an inert gas such as argon gas and nitrogen gas from a supply nozzle 4 for a cooling gas into a space under the tip of the flame F. Cooling is an operation for terminating or controlling the growth of the particles of nickel powder P, specifically, an operation of rapidly cooling a gas stream of around 1000° C. after the reduction in the temperature ranging from 400 to 800° C. The gas stream can be also cooled to a temperature lower than this range. By blowing an inert gas as mentioned above, the particle size of the nickel powder P can be controlled to prevent agglomeration of the nickel powder P. A cooling condition can be altered freely by changing the location of the supply nozzle 4 of the cooling gas in a vertical direction of the reduction reactor 1 and by installing them at several points, whereby the particle size can be controlled more accurately.

The mixed gas containing the nickel powder P, hydrochloric acid gas and an inert gas passed through the foregoing reduction and cooling processes is transferred to a collection process wherein the nickel powder P is separated and collected from the mixed gas. For the separation and collection, one or a combination of more than two of means including a bag-filter, separation by collecting in water or oil, and magnetic separation, but this is not limited to these means. Specifically, in the case of collection of the nickel powder P by a bag-filter, nickel powder P can be collected by introducing the mixed gas containing the nickel gas formed in the cooling process, hydrochloric acid gas, and an inert gas into the bag-filter. In the case of using separation by collecting in oil, a $C_{10-18}$, normal paraffin or a light oil is preferably used. In the case of using collection in water or oil, one or more of polyoxyalkyleneglycol, polyoxypropyleneglycol and derivatives thereof (monoalkylether or monoester), a surfactant including sorbitan or sorbitan monostearate, a metal deactivator typified by benzotriazole or its derivatives and a known antioxidant including phenol or amine is added in amounts of 10 to 1000 ppm to a liquid for collection, whereby it is effective for preventing agglomeration and corrosion of particles of metal powder. The nickel powder collected as described above is subjected to washing and drying to obtain the nickel powder of the present invention.

In the foregoing embodiment, the nickel powder having a desired particle size range of 0.1 to 1.0 μm can be formed and the growth of the particles can be promoted in proportion to the volume of chlorine gas supplied and mixed with a vapor of nickel chloride. Therefore, the nickel powder P can be controlled to the desired particle size by appropriately adjusting the volume of chlorine gas supplied. Furthermore, by mixing chlorine gas, the deviation of the particle sizes of the nickel powder P can be controlled, and attempts can be made the particle sizes make uniform, whereby the nickel powder having fewer fine and coarse particles and having a narrow particle size distribution can be obtained.

Figure 2:
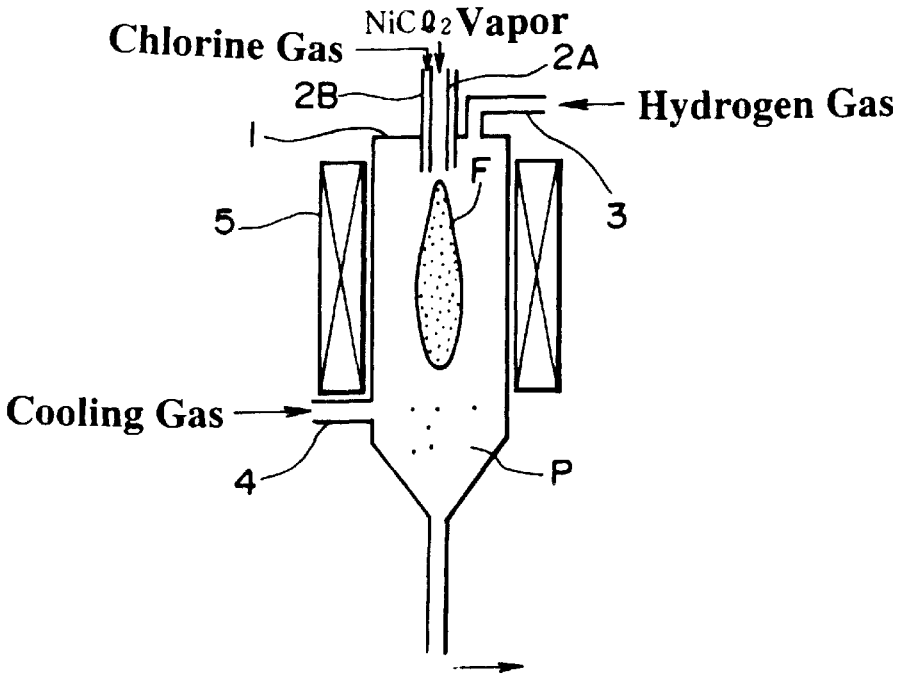
FIG. 2 is a drawing of a vertical section showing another example of an apparatus for production of a nickel powder according to the present invention.

FIG. 2 shows another embodiment of the present invention. In this embodiment, by using a double nozzle having an internal tube 2A and an external tube 2B as a supply nozzle, chlorine gas can be jetted from the external tube 2B into the reduction reactor 1. That is, the nozzle for a vapor of nickel chloride and chlorine gas into the reduction reactor 1 are installed separately and each nozzle is adjoined along the same axis. The volumes of the vapor of nickel chloride and chlorine gas to be supplied and volume of hydrogen gas to be supplied into the reduction reactor 1 are similar to the foregoing first embodiment. In the present embodiment, methods can be adopted wherein chlorine gas is continuously supplied into the reduction reactor I with a vapor of nickel chloride, or only chlorine gas is supplied intermittently.

By supplying chlorine gas continuously with a vapor of nickel chloride, smoothability of particle surfaces of the nickel powder P can be improved.

The nickel powder P formed by reduction may form as icicles by adhering to the outlet of the internal tube 2A for jetting vapor of nickel chloride onto the reduction reactor 1. Therefore, by supplying only chlorine gas intermittently from the external tube 2B, the growth of icicles of nickel powder can be prevented and a vapor of nickel chloride can be supplied without any trouble, whereby no influence may be exerted on the particle characteristics of the nickel powder. In this case, since a vapor of nickel chloride is supplied from the internal tube 2A and chlorine gas is supplied from the external tube 2B, chlorine gas is surrounded by vapor of nickel chloride, whereby an effect of preventing the growth of icicles of nickel powder P can be obtained. Furthermore, by adapting the supply means, sphericity of particles of the nickel powder P to be formed can be improved.

Details of the present invention are hereinafter explained referring to examples.

Example 1

The temperature in the reduction reactor 1 shown in FIG. 1 was maintained at a reduction temperature of 1000° C., and hydrogen gas was fed at a flow rate of 7.5 Nl/min from the supply nozzle 3 of hydrogen gas into the reduction reactor 1 to form a hydrogen atmosphere. Then, the vapor of nickel chloride was jetted from the supply nozzle 2 into the reduction reactor 1 to mix chlorine gas from the supply nozzle 6 of chlorine gas to obtain a nickel powder. The flow rate of the vapor of nickel chloride was maintained at an even 3.7 Nl/min and the flow rate of chlorine gas was changed to obtain the samples A, B, and C of the nickel powder. These samples were observed by SEM photograph and the average particle size was determined by the BET method. The results are shown in Table 1.

TABLE 1

| | A | B | C |
|---|---|---|---|
| $NiCl_2$ gas (Nl/min.) | 3.7 | 3.7 | 3.7 |
| Chlorine gas (Nl/min.) | 0 | 0.5 | 0.8 |
| Average particle size (μm) | 0.13 | 0.31 | 0.48 |

As can be seen from Table 1, by increasing the mixing ratio of chlorine gas to the vapor of nickel chloride, the particle size was increased. Therefore, by adjusting the mixing volume of chlorine gas based on this fact, it is clearly demonstrated that nickel powder to be formed could be controlled to have a desired particle size.

Example 2

The temperature in the reduction reactor 1 shown in FIG. 2 was maintained at 1000° C., the reduction reactor 1 was filled with a hydrogen atmosphere in the same way as in the foregoing Example 1. Then, the vapor of nickel chloride was fed at a flow rate of 1.7 Nl/min from the internal tube 2A. At the same time, chlorine gas was fed at a flow rate of 1.0 Nl/min from the external tube 2B to obtain the sample D of the nickel powder. Thereafter, in the middle of the forming process mentioned above, the flow rate of chlorine gas to be fed from the external tube 2B was reduced from 1.0 Nl/min to 0.5 Nl/min, and 0.5 Nl/min of chlorine gas was mixed from the internal tube 2A to obtain the sample E of the nickel powder. These samples were observed by SEM photography and the average particle size and the standard deviation were determined by BET. The results are shown in Table 2.

TABLE 2

| | D | E |
|---|---|---|
| average particle size ($\mu$m) | 0.47 | 0.44 |
| standard deviation | 0.26 | 0.14 |

From Table 2, it is seen that the deviation of the particle size was controlled and the uniformity of the particle size distribution was improved in the case of previously mixing chlorine gas with the vapor of nickel chloride (sample E), more than in the case of supplying the vapor of nickel chloride and chlorine gas into the reduction reactor 1 directly from each route of the internal tube 2A and the external tube 2B (sample D).

Example 3

The temperature in the reduction reactor 1 shown in FIG. 2 was maintained at the reduction temperature of 1000° C., and hydrogen gas was fed at a flow rate of 8 Nl/min from the supply nozzle 3 of hydrogen gas into the reduction reactor 1 to form a hydrogen atmosphere. Then, the supply of the vapor of nickel chloride was started at a flow rate of 3.7 Nl/min from the internal tube 2A. After 8 minutes from the beginning of the supply of the vapor of nickel chloride, a backpressure of the vapor of nickel chloride was increased. Therefore, chlorine gas was supplied at a flow rate of 0.5 Nl/min from the external tube 2B. After 1 minute from the beginning of the supply of chlorine gas, the backpressure of the vapor of nickel chloride returned to a normal range. Thereafter, continuous operation was conducted for 1 hour. However, an increase of the backpressure of the vapor of nickel chloride was not observed.

Furthermore, the operation, in which the supply of chlorine gas was repeated intermittently every 2 minutes, was conducted for 1 hour. However, an increase of the backpressure of the vapor of nickel chloride was not observed and stable continuous operation could be conducted. The nickel powder obtained by the continuous operation was observed by SEM photography and the average particle size was determined by the BET method. As a result, the average particle size was shown to have a superior value of 0.28 $\mu$m. In particular, by supplying chlorine gas intermittently, the growth of icicles of nickel powder was not practically observed.

Example 4

The temperature in the reduction reactor 1 shown in FIG. 2 was maintained at the reduction temperature of 1000° C., and hydrogen gas was fed from the supply nozzle 3 of hydrogen gas into the reduction reactor 1 to form a hydrogen atmosphere. Then, the vapor of nickel chloride was supplied from the internal tube 2A, and at the same time, chlorine gas was supplied from the external tube 2B continuously. The volume of the vapor of nickel chloride to be supplied was maintained at 1.9 Nl/min and each volume of hydrogen gas and chlorine gas to be supplied was changed to obtain the samples F, G, and H of the nickel powder. These samples were observed by SEM photography and the average particle size was determined by the BET method. The results are shown in Table 3.

TABLE 3

| | F | G | H |
|---|---|---|---|
| hydrogen gas (Nl/min.) | 3.7 | 4.2 | 5.5 |
| $NiCl_2$ gas (Nl/min.) | 1.9 | 1.9 | 1.9 |
| chlorine gase (Nl/min.) | 0.5 | 1.0 | 1.5 |
| average particle size ($\mu$m) | 0.38 | 0.42 | 0.52 |

As is clear from Table 3, the nickel powder was grew remarkably by increasing the volume of chlorine gas to supplied from the external tube 2B. Therefore, adjusting the volume of chlorine gas to be mixed can control the particle size of the nickel powder. Further, the growth of icicles of nickel powder was not observed.

Example 5

The temperature in the reduction reactor 1 shown in FIG. 2 was maintained at the reduction temperature of 1000° C., and hydrogen gas was fed at a flow rate of 3.7 Nl/min from the supply nozzle 3 of hydrogen gas into the reduction reactor 1 to form a hydrogen atmosphere. Then, the supply of the vapor of nickel chloride from the internal tube 2A was started at a flow rate of 1.87 Nl/min and continuous operation was conducted for 60 minutes. Thereafter, chlorine gas was supplied at a flow rate of 0.5 Nl/min from the external tube 2B and the forming reaction was terminated after 60 minutes. The sample I of the nickel powder obtained by supplying only the vapor of nickel chloride in the early stage and the sample J of the nickel powder obtained by mixing chlorine gas were observed by SEM photography and an aspect ratio (long axis/short axis) of the particles was determined. A smaller aspect ratio shows higher sphericity. The results were shown in Table 4.

TABLE 4

| | I | J |
|---|---|---|
| aspect ratio | 1.20 | 1.09 |

As is clear from Table 4, the aspect ratio was decreased and the sphericity can be improved by supplying chlorine gas from the external tube 2B.

As explained above, the process for production of nickel powder of the present invention is one in which chlorine gas is supplied to an atmosphere of a reductive gas with a vapor of nickel chloride and nickel chloride is reduced to form a nickel powder. Since growth of particles of nickel powder can be controlled by chlorine gas to be supplied, the particle size of the nickel powder can be controlled appropriately and also uniformity of particle size, smoothability of the surface of the particles and sphericity can be improved.

What is claimed is:

1. A process for production of a nickel powder comprising supplying chlorine gas together with a vapor of nickel chloride to an atmosphere of a reductive gas so as to reduce said nickel chloride to metal powder.

2. A process for production of a nickel powder as claimed in claim 1, wherein the ratio of chlorine gas is 0.01 to 0.5 moles per 1 mole of said vapor of nickel chloride.

3. A process for production of a nickel powder as claimed in claim 1, wherein the vapor of nickel chloride is supplied from one of an internal tube and an external tube of arranged coaxially and chlorine gas is supplied from the other of said tubes.

4. A process for production of a nickel powder as claimed in claim 3, wherein the vapor of nickel chloride is supplied from an internal tube of a double coaxial tube and chlorine gas is supplied from the external tube.

5. A process for production of a nickel powder as claimed in claim 1, wherein nickel chloride is reduced by supplying a mixed gas of a vapor of nickel chloride and chlorine gas into a reduction reactor of an atmosphere of a reductive gas.

6. A process for production of a nickel powder as claimed in claim 1, wherein said supplying step comprises supplying a vapor of nickel chloride and chlorine gas downward and vertically, from a supply nozzle arranged at the top of a vertical reduction reactor, toward the inside of the reduction reactor.

* * * * *